US005615781A

United States Patent [19]

Janssen

[11] Patent Number: 5,615,781

[45] Date of Patent: Apr. 1, 1997

[54] LITERATURE DISPLAY SYSTEM

[76] Inventor: Daniel A. Janssen, 101-765-6 Street, New Westminster, BC, Canada, V3L-3C6

[21] Appl. No.: 528,997

[22] Filed: Sep. 21, 1995

[51] Int. Cl.[6] ..... A45F 5/12

[52] U.S. Cl. ..... 211/50; 211/118; 211/184; 248/456; 248/460

[58] Field of Search ..... 248/456, 457, 248/460; 211/50, 194, 184, 118; 206/449

[56] References Cited

U.S. PATENT DOCUMENTS

| | | | |
|---|---|---|---|
| 568,139 | 9/1896 | Haynes | 248/457 |
| 660,171 | 10/1900 | Snell | 248/460 X |
| 1,470,549 | 10/1923 | Steinmeyer | 211/50 |
| 1,485,786 | 3/1924 | Kraft | 248/460 |
| 1,846,798 | 2/1932 | Dixon | 248/460 X |
| 2,934,214 | 4/1960 | Mogulescu et al. | 211/184 X |
| 3,065,943 | 11/1962 | Hull | 248/460 |
| 3,612,292 | 10/1971 | Nervig | 211/184 |
| 3,897,037 | 7/1975 | Johnson et al. | 248/460 |
| 3,912,087 | 10/1975 | Zeischegg | 211/194 |
| 4,079,841 | 3/1978 | Castel | 211/50 X |
| 4,239,306 | 12/1980 | Klaus | 211/194 X |
| 4,588,074 | 5/1986 | Strong et al. | 248/460 X |
| 5,085,328 | 2/1992 | Evenson | 211/194 X |
| 5,152,405 | 10/1992 | Schriner | 211/50 |

*Primary Examiner*—Ko Chan

[57] ABSTRACT

A system for supporting literature relative to a support surface. The inventive device includes a pocket assembly which can be secured to a wall surface or supported upon a table. A plurality of dividing members can be provided for partitioning the pocket assembly to fit a particular item of literature. A plurality of the pocket assemblies can be mounted to a wall surface in a desired orientation or coupled together so as to hang in a vertical position.

1 Claim, 5 Drawing Sheets

Fig. 1
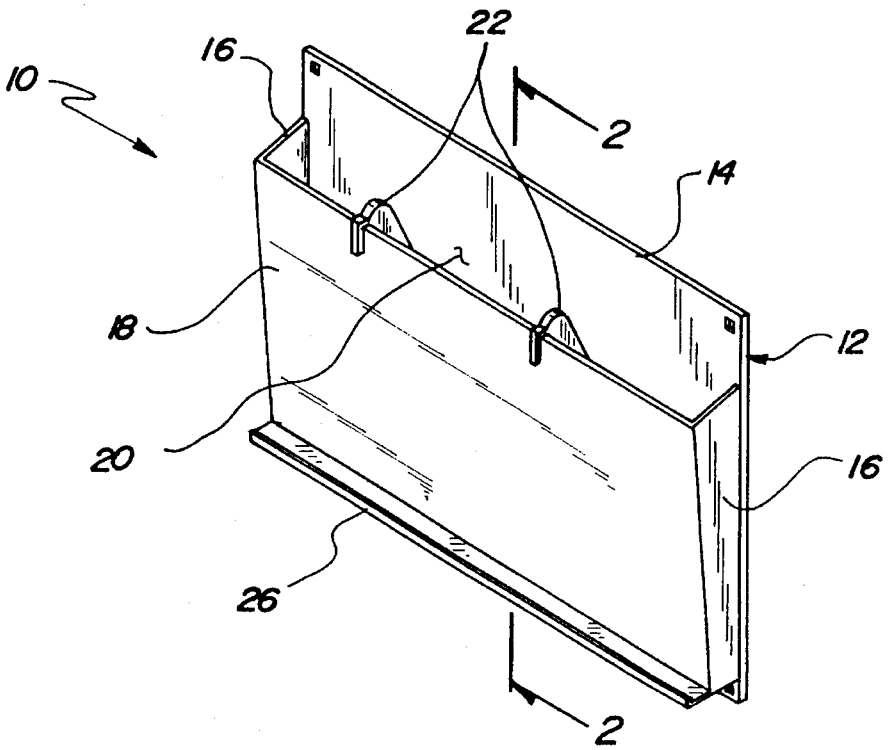
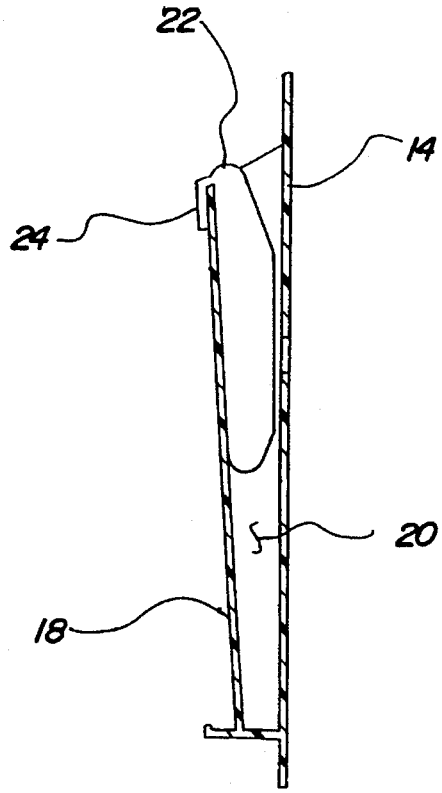
Fig. 2

LITERATURE DISPLAY SYSTEM

BACKGROUND OF THE INVENTION

1. Field of the Invention

The present invention relates to object supporting devices and more particularly pertains to an literature display system for supporting literature relative to a support surface.

2. Description of the Prior Art

The use of object supporting devices is known in the prior art. More specifically, object supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art object supporting devices include U.S. Pat. No. 5,205,526; U.S. Pat. No. 4,582,286; U.S. Pat. No. 4,282,667; Design U.S. Pat. No. 344,637; Design U.S. Pat. No. 334,479; and Design U.S. Pat. No. 324,883.

While these devices fulfill their respective, particular objectives and requirements, the aforementioned patents do not disclose a literature display system for supporting literature relative to a support surface which includes a pocket assembly that can be secured to a wall surface or supported upon a table, and a plurality of dividing members for partitioning the pocket assembly to fit a particular item of literature, wherein a plurality of the pocket assemblies can be mounted to a wall surface in a desired orientation or coupled together so as to hang in a vertical position.

In these respects, the literature display system according to the present invention substantially departs from the conventional concepts and designs of the prior art, and in so doing provides an apparatus primarily developed for the purpose of supporting literature relative to a support surface.

SUMMARY OF THE INVENTION

In view of the foregoing disadvantages inherent in the known types of object supporting devices now present in the prior art, the present invention provides a new literature display system construction wherein the same can be utilized for supporting literature relative to a support surface. As such, the general purpose of the present invention, which will be described subsequently in greater detail, is to provide a new literature display system apparatus and method which has many of the advantages of the object supporting devices mentioned heretofore and many novel features that result in a literature display system which is not anticipated, rendered obvious, suggested, or even implied by any of the prior art object supporting devices, either alone or in any combination thereof.

To attain this, the present invention generally comprises a system for supporting literature relative to a support surface. The inventive device includes a pocket assembly which can be secured to a wall surface or supported upon a table. A plurality of dividing members can be provided for partitioning the pocket assembly to fit a particular item of literature. A plurality of the pocket assemblies can be mounted to a wall surface in a desired orientation or coupled together so as to hang in a vertical position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new literature display system apparatus and method which has many of the advantages of the object supporting devices mentioned heretofore and many novel features that result in a literature display system which is not anticipated, rendered obvious, suggested, or even implied by any of the prior an object supporting devices, either alone or in any combination thereof.

It is another object of the present invention to provide a new literature display system which may be easily and efficiently manufactured and marketed.

It is a further object of the present invention to provide a new literature display system which is of a durable and reliable construction.

An even further object of the present invention is to provide a new literature display system which is susceptible of a low cost of manufacture with regard to both materials and labor, and which accordingly is then susceptible of low prices of sale to the consuming public, thereby making such literature display systems economically available to the buying public.

Still yet another object of the present invention is to provide a new literature display system which provides in the apparatuses and methods of the prior art some of the advantages thereof, while simultaneously overcoming some of the disadvantages normally associated therewith.

Still another object of the present invention is to provide a new literature display system for supporting literature relative to a support surface.

Yet another object of the present invention is to provide a new literature display system which includes a pocket assembly that can be secured to a wall surface or supported upon a table, a plurality of dividing members for partitioning the pocket assembly to fit a particular item of literature, wherein a plurality of the pocket assemblies can be mounted to a wall surface in a desired orientation or coupled together so as to hang in a vertical position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a literature display system according to the present invention.

FIG. 2 is a cross sectional view taken along line 2—2 of FIG. 1.

DESCRIPTION OF THE PREFERRED EMBODIMENT

Figure 3:
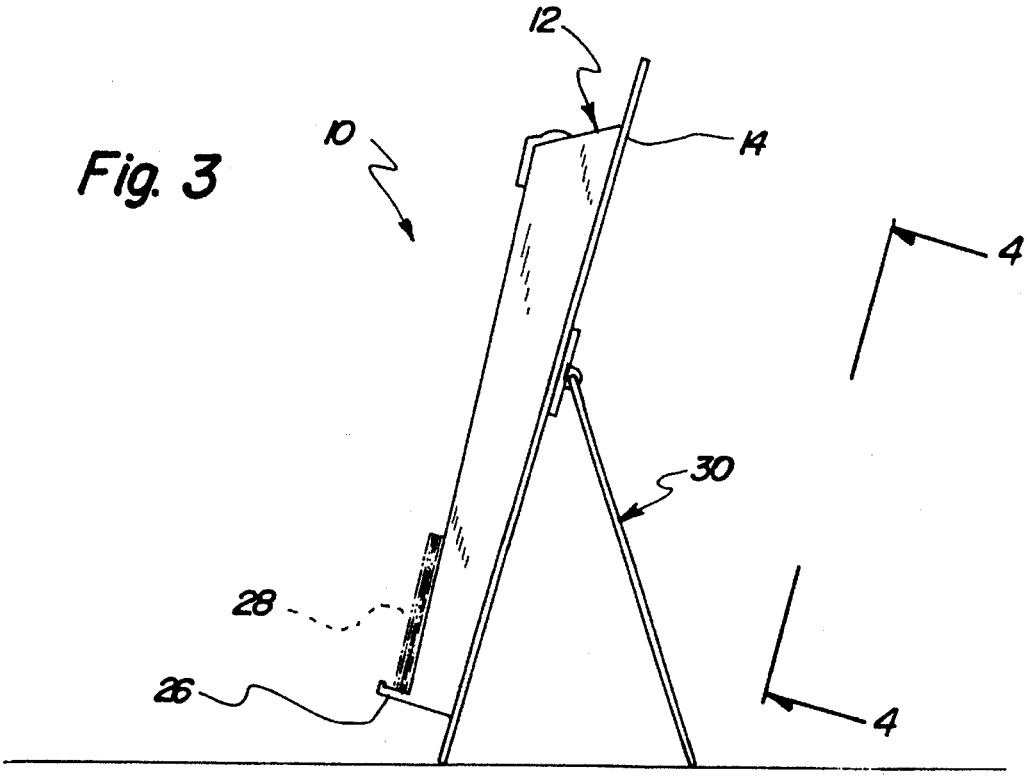
FIG. 3 is a side elevation view of the present invention including a horizontal support assembly.
Figure 4:
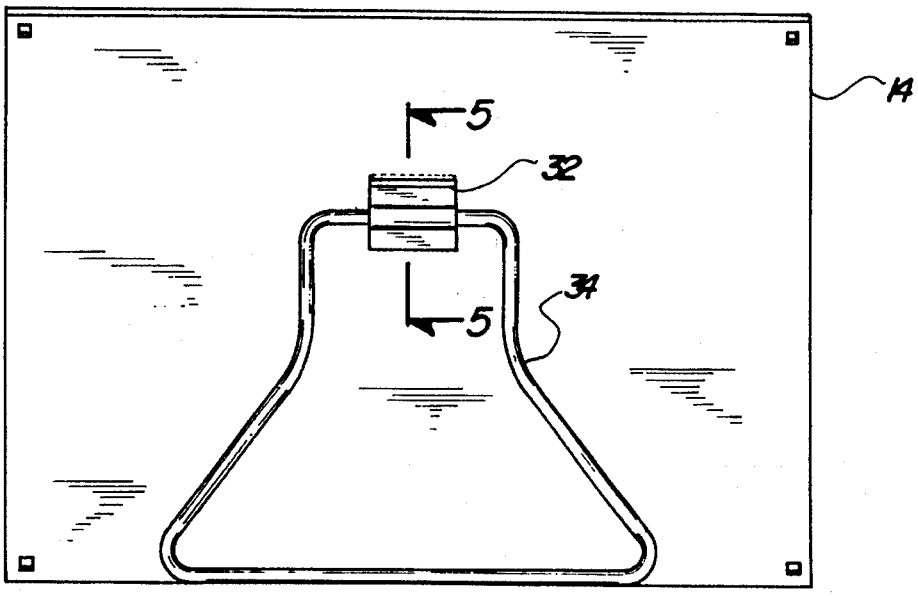
FIG. 4 is a rear elevation view of the invention taken from line 4—4 of FIG. 3.

With reference now to the drawings, and in particular to FIGS. 1–10 thereof, a new literature display system embodying the principles and concepts of the present invention and generally designated by the reference numeral 10 will be described.

More specifically, it will be noted that the literature display system 10 comprises a pocket assembly 12 including a substantially planar main panel 14 having a pair of lateral panels 16 projecting therefrom and oriented in a spaced relationship relative to one another. A front panel 18 extends between the lateral panels 16 and in a spaced relationship relative to the main panel 14 so as to define a receiving cavity 20 within which literature such as brochures or pamphlets can be positioned. A bottom panel 21 extends between the lateral panels 16 and between both the front panel 18 and the main panel 14 so as to enclose a lower end of the receiving cavity 20. By this structure, literature or like objects positioned within the pocket assembly 12 will be supported within the receiving cavity 20 with portions of the literature projecting from the receiving cavity for viewing thereof.

If desired, one or more dividing members 22 can be positioned within the receiving cavity 20 and slidably mounted to an upper edge of the front panel 18 so as to partition the receiving cavity 20 to fit a particular brochure or other item of literature. To this end, each of the dividing members 22 includes a substantially L-shaped bracket 24 which extends over the upper edge of the front panel 18 so as to frictionally engage the same to support the dividing member 22 in a desired orientation between the lateral panel 16 within the receiving cavity 21).

As shown in FIGS. 1 through 3, the pocket assembly 12 of the present invention 10 may further comprise a shelf panel 26 projecting from the front panel 18 upon which items such as business cards 28 or writing instruments can be positioned. The shelf panel 26 may project from any portion of the pocket assembly 12, but is preferably formed with the bottom panel 21 so as to project from a lower edge of the front panel 18 as shown in figures.

Figure 5:
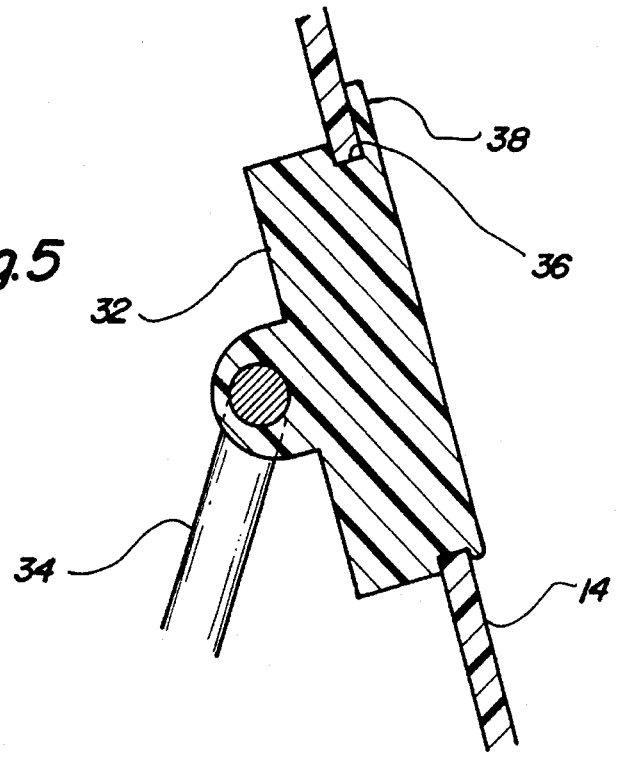
FIG. 5 is a cross sectional view taken along line 5—5 of FIG. 4.

Referring now to FIGS. 3 though 5, it can be shown that the present invention 10 may further comprise a horizontal support assembly 30 coupled to the pocket assembly 12 for supporting the same in a substantially vertical orientation upon a horizontal support surface. To this end, the horizontal support assembly 30 preferably comprises a hinge 32 mounted to a back surface of the main panel 14, with a support leg 34 pivotally mounted to and projecting from the hinge 32 at an oblique angle relative to the main panel 14 for engagement with the horizontal support surface such that the pocket assembly 12 is supported by the support leg 34 and a lower edge of the main panel 14. As shown in FIG. 5, the hinge 32 can be mounted within a hinge aperture 36 directed through the main panel 14 of the pocket assembly 12. The hinge 32 desirably includes an unlabeled groove extending about a periphery thereof which cooperates with a perimeter flange 38 of the hinge 32 so as to engage the main panel 14 when the hinge is positioned through the hinge aperture 36. By this structure, the horizontal support assembly 30 can be selectively coupled and decoupled from the pocket assembly 12 as desired by an end user.

Figure 6:
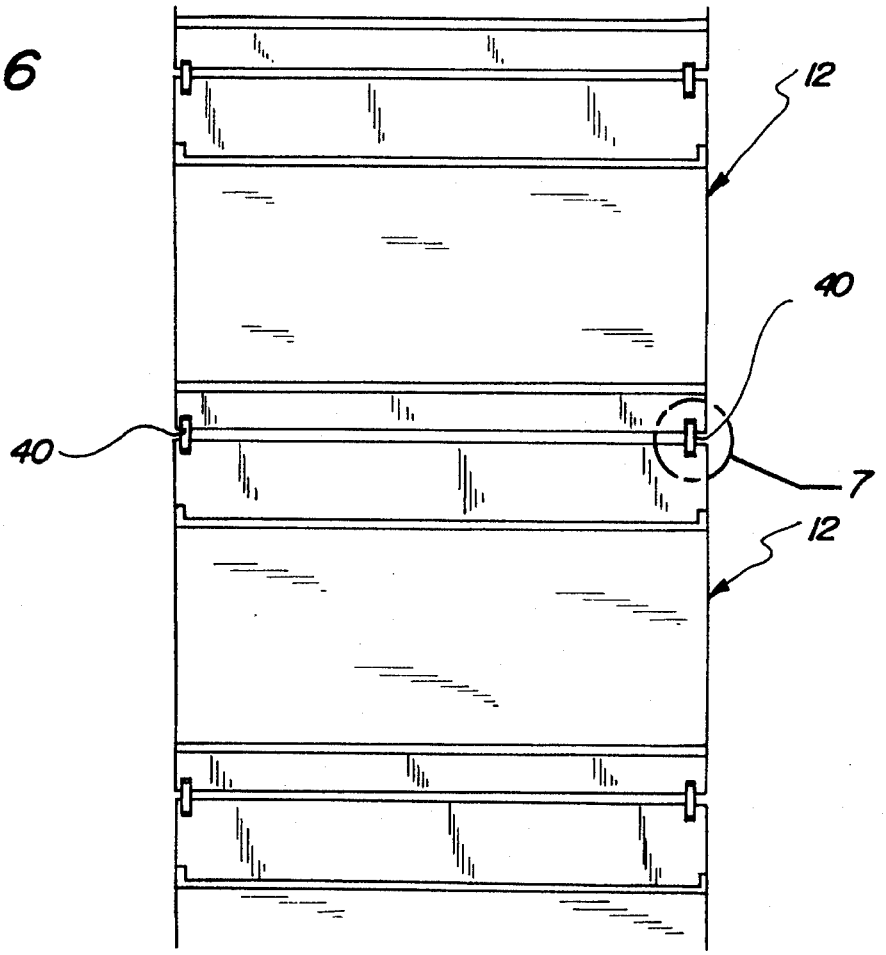
FIG. 6 is a front elevation view of the present invention including a plurality of pocket assemblies coupled together.
Figure 7:
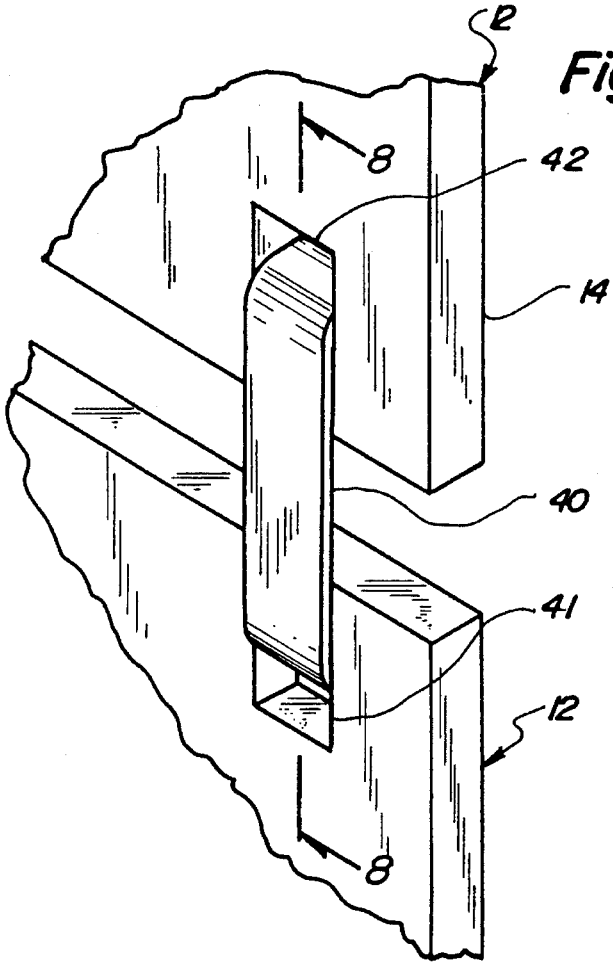
FIG. 7 is an enlarged isometric illustration of the area set forth in FIG. 6.
Figure 8:
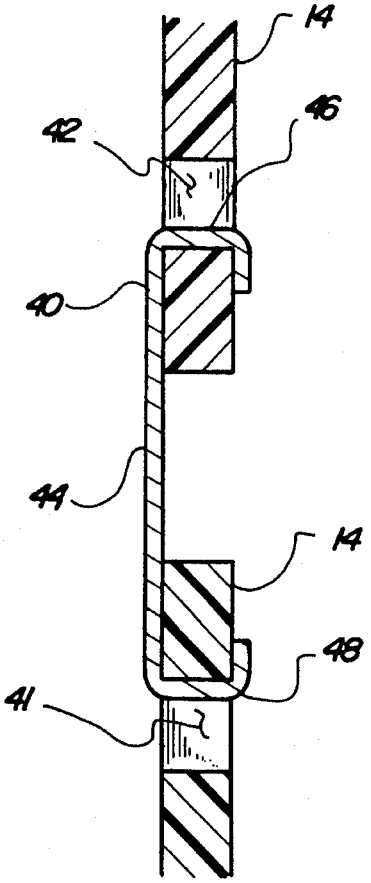
FIG. 8 is a cross sectional view taken along line 8—8 of FIG. 7.

Referring now to FIGS. 6 through 8, it can be shown that the present invention 10 may be realized in a plurality of pocket assemblies 12 coupled together in a vertical orientation by a plurality of joining links 40 extending therebetween. To this end, the main panel 14 of each of the pocket assemblies 12 is desirably shaped so as to define a pair of upper apertures 41 positioned proximal to an upper edge of the main panel 14, and a pair of lower apertures 42 positioned proximal to a lower edge of the main panel 14. The joining links 40, as shown for a single joining link in FIG. 7, can thus be engaged to the upper apertures 41 of one of the pocket assemblies 12 and to one of the lower apertures 42 of another pocket assembly 12 so as to couple the pocket assemblies together in a substantially vertical orientation. As shown in FIG. 8, each of the joining links 40 comprises an elongated center member 44 having a first U-shaped end 46 formed at a first end thereof which can be positioned through one of the lower apertures 42 in the main panel 14 of pocket assembly 12, and a second U-shaped end 48 which can be positioned through one of the upper apertures 41 of another main panel 14. The U-shaped ends 46 and 48 are oriented so as to face one another and capture portions of the main panels 14 therebetween.

It should be noted that the pocket assembly 12 can be secured to a vertical wall surface through a direction of threaded fasteners or the like through the main panel 14. Thus, a plurality of the pocket assemblies 12 can also be secured to a vertical wall surface in any desired orientation as determined by an end user.

Figure 9:
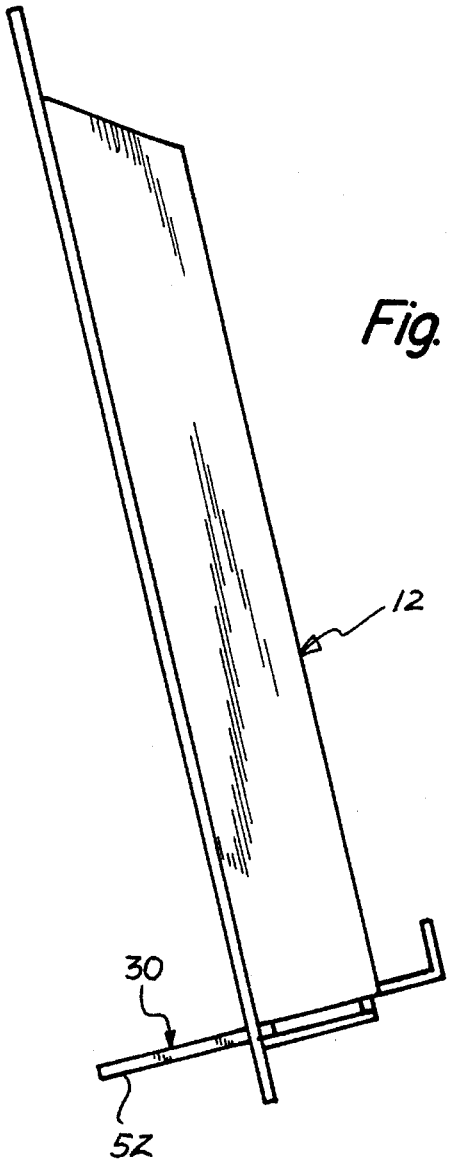
FIG. 9 is a side elevational view of the invention including an alternative form of the horizontal support assembly.
Figure 10:
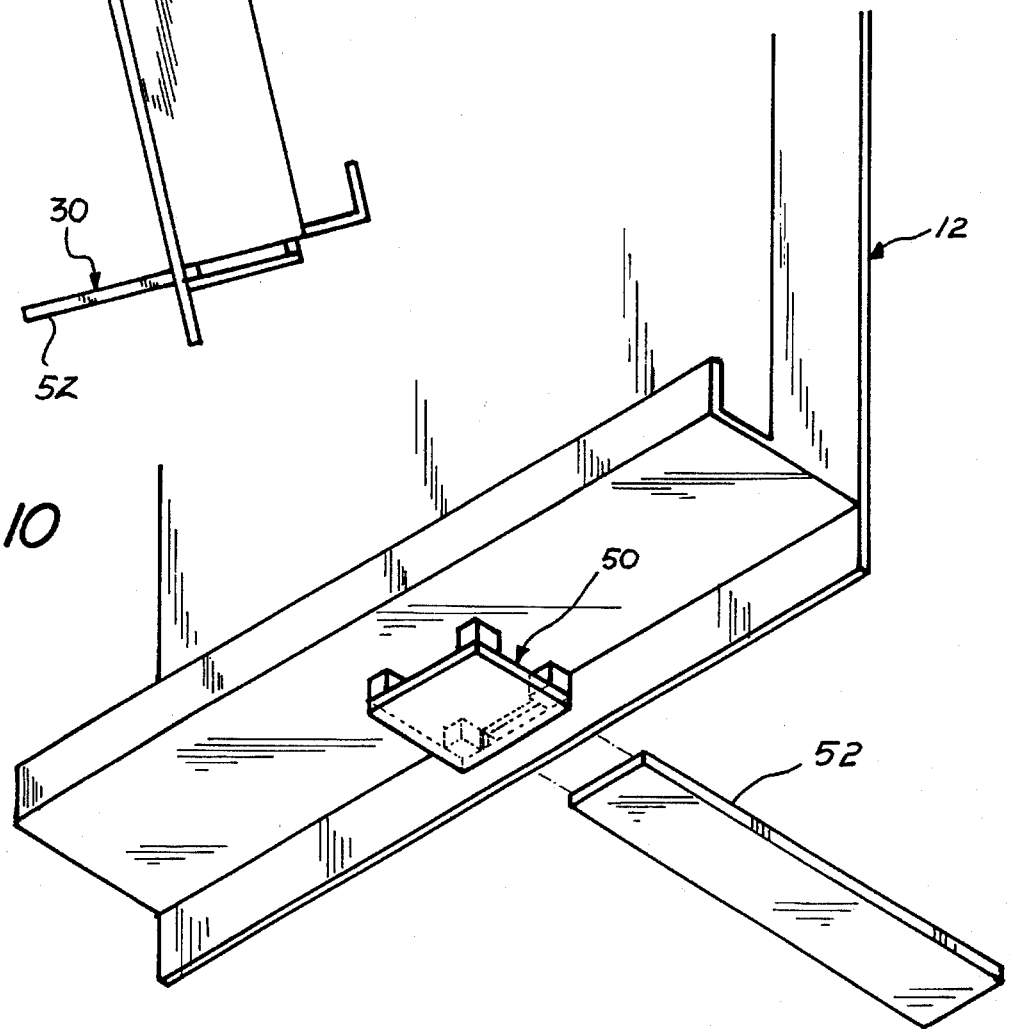
FIG. 10 is an exploded bottom isometric illustration of the horizontal support assembly of the invention.

Turning now to FIGS. 9 and 10 wherein an alternative form of the horizontal support assembly 30 is illustrated, it can be shown that the horizontal support assembly may alternative comprise a center leg receiver 50 mounted to a lower surface of the shelf panel 26 of the pocket assembly 12. A support leg 52 is slidably received within the center leg receiver 50 so as to project rearwardly of the pocket assembly 12 such that the pocket assembly can be placed upon a support surface, with the projecting support leg 52 supporting the pocket assembly leaning thereonto, as shown in FIG. 9.

In use, the literature display system 10 according to the present invention permits an individual to display a variety of literature, such as brochures, pamphlets, business cards, or the like in a variety of orientations relative to either a vertical support surface or a horizontal support surface. The device 10 is configured to be readily adaptable and portable to various locations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A literature display system comprising:

a pocket assembly having a receiving cavity and including a substantially planar main level having a pair of lateral panels projecting therefrom and oriented in a spaced relationship relative to one another, a front panel extending between the lateral panels in a spaced relationship relative to the main panel so as to define the receiving cavity, and a bottom panel extending between the lateral panels and between both the front panel and the main panel, the main panel being shaped so as to define a pair of upper apertures positioned proximal to an upper edge of the main panel, and a pair of lower apertures positioned proximal to a lower edge of the main panel, joining links adapted to be engaged to the upper apertures and adjacent lower apertures of another similarly constructed pocket assembly so as to permit coupling of two pocket assemblies together in a substantially vertical orientation whereby one pocket assembly hangs below another pocket assembly, the joining links each comprising an elongated center member having a first U-shaped end formed at a first end thereof and a second U-shaped end oriented so as to face the first U-shaped end;

a dividing member positioned within the receiving cavity and slidably mounted to an upper edge of the front panel so as to partition the receiving cavity, the dividing member including a substantially L-shaped bracket which extends over the upper edge of the front panel and frictionally engages the same to support the dividing member in a desired orientation between the lateral panels and within the receiving cavity;

a shelf panel projecting beyond the front panel, the shelf panel extends from the bottom panel so as to project beyond a lower edge of the front panel;

a horizontal support assembly coupled to the pocket assembly for supporting the pocket assembly in a substantially vertical orientation upon a horizontal support surface, the horizontal support assembly comprising a hinge mounted to a back surface of the main panel, a support leg projecting from the hinge at an oblique angle relative to the main panel for engagement with the horizontal support surface such that the pocket assembly can be supported by the support leg and a lower edge of the main panel, the main panel being shaped so as to define a hinge aperture directed therethrough, with the hinge including a groove extending about a periphery thereof positioned within the hinge aperture to removably couple the hinge to the main panel.

* * * * *